US007292209B2

(12) United States Patent
Rast

(10) Patent No.: US 7,292,209 B2
(45) Date of Patent: Nov. 6, 2007

(54) SYSTEM AND METHOD OF DRIVING AN ARRAY OF OPTICAL ELEMENTS

(75) Inventor: Rodger H. Rast, Rancho Cordova, CA (US)

(73) Assignee: Rastar Corporation, Gold River, CA (US)

( * ) Notice: Subject to any disclaimer, the term of this patent is extended or adjusted under 35 U.S.C. 154(b) by 814 days.

(21) Appl. No.: 09/924,973

(22) Filed: Aug. 7, 2001

(65) Prior Publication Data

US 2002/0021269 A1 Feb. 21, 2002

Related U.S. Application Data

(60) Provisional application No. 60/223,659, filed on Aug. 7, 2000.

(51) Int. Cl.
*G09G 3/32* (2006.01)

(52) U.S. Cl. ..... 345/82; 345/81; 345/84; 315/169.3

(58) Field of Classification Search ..... 345/55, 345/76–104, 564, 565, 98, 204, 566, 572
See application file for complete search history.

(56) References Cited

U.S. PATENT DOCUMENTS 4,152,693 A * 5/1979 Ashworth, Jr. ..... 340/990
4,355,348 A 10/1982 Williams
4,445,132 A 4/1984 Ichikawa et al.
5,030,946 A * 7/1991 Yamamura ..... 345/567
5,063,462 A 11/1991 Nakagawa et al.
5,184,114 A * 2/1993 Brown ..... 345/83
5,225,819 A * 7/1993 Hosotani et al. ..... 345/20
5,233,337 A * 8/1993 Takahashi ..... 345/82
5,410,328 A 4/1995 Yoksza et al.
5,420,482 A 5/1995 Phares
5,436,535 A 7/1995 Yang
5,508,721 A * 4/1996 Hattori ..... 345/554
5,621,282 A 4/1997 Haskell
5,712,650 A 1/1998 Barlow
5,734,361 A * 3/1998 Suzuki et al. ..... 345/74.1
5,780,321 A 7/1998 Shieh et al.
5,789,766 A 8/1998 Huang et al.
5,812,105 A 9/1998 Van de Ven
5,818,404 A 10/1998 Lebby et al.
5,827,753 A 10/1998 Huang et al.
5,945,789 A 8/1999 Chou
5,977,960 A * 11/1999 Nally et al. ..... 345/563

(Continued)

FOREIGN PATENT DOCUMENTS

GB 2099221 12/1982

(Continued)

*Primary Examiner*—Duc Q Dinh
(74) *Attorney, Agent, or Firm*—Rodger H. Rast

(57) ABSTRACT

A system and/or method for controlling a display array without the use of row and column drivers. The display elements within the system are configured to maintain an active address signal in response to a received signal containing serially encoded display settings. Each display element is loaded with an address of where it is located within the array. The display elements then extract the display information from the signal upon matching the address, wherein they output the correct display setting for their position within the array. An optical programming method is described for setting the address of the display elements in-situ.

72 Claims, 8 Drawing Sheets

U.S. PATENT DOCUMENTS 5,995,070 A * 11/1999 Kitada ..... 345/83
6,016,038 A 1/2000 Mueller et al.
6,016,132 A 1/2000 Takahashi
6,022,155 A * 2/2000 Nakajima ..... 400/118.2
6,065,854 A 5/2000 West et al.
6,144,352 A 11/2000 Matsuda et al.
6,157,366 A * 12/2000 Sharma ..... 345/692
6,232,724 B1 5/2001 Onimoto et al.
6,252,351 B1 6/2001 Koizumi et al.
6,292,901 B1 9/2001 Lys et al.
6,313,816 B1 11/2001 Kojima et al.
6,317,138 B1 11/2001 Yano et al.
6,329,758 B1 12/2001 Salam
6,342,897 B1 1/2002 Wen
6,362,801 B1 3/2002 Yuhara
6,448,900 B1 9/2002 Chen
6,472,946 B2 10/2002 Takagi
6,492,725 B1 12/2002 Loh et al.
6,496,162 B2 12/2002 Kawakami et al.
6,528,954 B1 3/2003 Lys et al.
6,545,652 B1 * 4/2003 Tsuji ..... 345/82
6,563,480 B1 5/2003 Nakamura
6,568,109 B2 5/2003 Sanders
6,594,606 B2 7/2003 Everitt
6,608,453 B2 8/2003 Morgan et al.
6,639,574 B2 10/2003 Scheibe
6,646,654 B2 11/2003 Takagi
6,677,918 B2 1/2004 Yuhara
6,734,875 B1 * 5/2004 Tokimoto et al. ..... 345/690
2002/0017962 A1 2/2002 Takagi
2002/0135572 A1 9/2002 Weindorf
2002/0163513 A1 11/2002 Tsuji
2002/0180719 A1 12/2002 Nagai et al.
2003/0016198 A1 1/2003 Nagai et al.
2003/0111533 A1 6/2003 Chang

FOREIGN PATENT DOCUMENTS

JP 1161783 6/1989

* cited by examiner

SYSTEM AND METHOD OF DRIVING AN ARRAY OF OPTICAL ELEMENTS

CROSS-REFERENCE TO RELATED APPLICATIONS

This application claims priority from U.S. provisional application Ser. No. 60/223,659 filed on Aug. 7, 2000 by the same title.

STATEMENT OF FEDERALLY SPONSORED RESEARCH OR DEVELOPMENT

Not Applicable

REFERENCE TO A MICROFICHE APPENDIX

Not Applicable

BACKGROUND OF THE INVENTION

1. Field of the Invention

This invention pertains generally to displays comprising an array of display elements and more particularly to a method and system wherein array address information is encoded within each display element wherein the elements may be controlled utilizing simplified driver circuits.

2. Description of the Background Art

Display arrays utilize a collection of elements which are controlled in concert with one another for displaying text or graphics. A scrolling LED advertising panel is typical of such a display array. These displays are increasingly utilized both outdoor and indoor for conveying information and advertising. The display elements within these arrays are typically LEDs which are usually provided as single color, dual color, or multicolor, such as red/green/blue (RGB). Large displays may encompass tens of thousands of elements for a large area display or marquee. The use of incandescent bulbs in signs is also prevalent within certain forms of signage, however, as the cost of LEDS decreases and the available intensity increases, fewer signs are utilizing incandescent lighting elements. Although display arrays have become increasingly important, their basic designs has not significantly changed since the 1970s.

In order to appreciate the beneficial aspects of the present invention, it is necessary to generally understand the design and construction of display arrays as they are currently being designed and produced. Elements of a display array are generally arranged in rectangular arrays with rows and columns. In systems with only a few discrete display elements, each element may be individually turned on and off by a controller in a direct (non-multiplexed) operation. However, display multiplexing, as generally shown in FIG. 1, was introduced to overcome the difficulty with providing individual signals for each element of a large array. Basically, in a multiplexed display each display element is connected across a row and a column, such that any element may be enabled, or lit up, by providing power on a column while pulling one of the rows to ground. By quickly scanning across the rows and columns each element can be individually driven for a small duty cycle. Multiplexing reduces the number of control lines necessary but results in a commensurate loss of maximum output intensity. It will be appreciated that each display element may only be driven for a small percentage of the time, depending on the depth of multiplexing utilized, and the achievable display intensity is therefore reduced. In the array of FIG. 1 it will be appreciated that power to one column may be applied wherein current sinking by the row driver activates any LEDs in that column, wherein each LED can be activated for a maximum of ⅙ of the total time as there are a total of six columns which are being driven. In displays requiring greater intensity, such as outdoor displays, the depth of multiplexing must be reduced and many displays utilize drivers for each display element.

A typical multiplexed small to medium sized display array comprises a housing, a backplane, driver chips distributed on the backplane, one or more controller chips for orchestrating the driver chips, a main processor, a power supply, and of course the display elements themselves. Considering a small two line display of 16 rows and 250 columns it will be appreciated that traces must be routed on the backplane to each element within the 16 rows and 250 columns. If multi-color elements are being used, then the two or three sets of rows and columns may be required for each element. On an array of even this miniature size, it would not be possible to multiplex the whole display with only one LED on at a time as each LED could be active a maximum of $1/4000^{th}$ of the time. Therefore, separate drivers are typically provided for each column and the 16 vertical rows would then be multiplexed so that the elements can be active up to $1/16^{th}$ of the overall time which would define maximum element brightness. Signal traces and drivers are required for each of the 250 columns and the 16 rows, and that the controller software must accommodate the structure of the multiplexing which is different for each display. Larger displays are generally composed of panels which act as separate displays that each have a controller and a set of row and columns. Each of these separate panels is integrated to one another by another level of driver circuitry. Very large displays can appear reminiscent of an antiquated mainframe computer, replete with complex racks of driver cards, and they are extremely expensive to produce and maintain. When faulty driver circuits occur, entire rows or columns of the display are affected and a service person is often required to locate a suitable replacement (often difficult as the driver circuits change so often) and then remove the surface mounted integrated circuits, with perhaps 100-200 leads, from the display array and solder in the new device.

Manufacture of display arrays is also complex and expensive. In order to fabricate a multiplexed display of a different/custom size a completely new design is required to suit the characteristics of the display. The design requires not only the design of a new backplane, but of all the drive electronics, as the row and column drivers are integrated for the specific number of rows and columns, and to one another, and also for the particular type and configuration of display element being driven. Often each display type and size utilizes its own proprietary control software to properly control the custom array of driver circuits whose operation is to be coordinated. For example, even a small change such as changing from 16 to 18 rows in the previous example would require a complete redesign of the display which would obviously be extremely expensive. Furthermore, it will be understood that large backplanes are expensive to fabricate and populate with distributed driver chips. Therefore, the costs are high even for a production run of displays, such as the 16×250 element array.

It is apparent that the display arrays pose numerous unresolved design problems with regard to multiplexed brightness, production cost, engineering cost, the capability to customize, the reliability, and the serviceability. Therefore, a need exists for a method and apparatus which would provide for controlling large arrays of display elements without the present "row and column" complexities and limitations.

The universal scanning method and system for driving optical elements in accordance with the present invention satisfies that need, as well as others, and overcomes deficiencies in previously known display array drive techniques.

BRIEF SUMMARY OF THE INVENTION

The present invention is a method and system for driving and controlling arrays of display elements. The display elements used within the method can incorporate any conventional type of light modulation element (light generative, or reflective), such as LED, incandescent, laser, LCD, electronic paper, electromechanical, etc. By way of example and not of limitation, the display elements of the present invention will hereafter be referred to as universal scanning display elements, and will be considered to produce one or more LED outputs, referred to as a universal scanning LED, or USLED. Each USLED element appears similar to a conventional LED, yet contains on-board drivers and control circuitry. Incorporation of onboard drivers within an element has been possible for decades, yet doing so would not provide any benefits with display elements, such as LEDs, as the element would still require row and column multiplexing. The USLEDs have their own driver circuitry, and all elements, even elements which output three color RGB, are preferably fabricated as two pin devices. A prime advantage of USLEDs is that they may be arranged into arrays without the need of row and column drivers, and furthermore they do not require a complex backplane containing separate row and column lines. The display elements of the present invention may be easily formed into arrays of any form factor, shape, or curvature without additional complexity. Yet even without row and column signal lines, the display elements are individually controlled.

The USLEDs of the present invention incorporate what is being referred to herein as Array Position Addressing (APA) which allows the elements to be controllable addressed without the need of individual row and column lines. One aspect of APA on USLEDs involves a technique of in-situ optical programming wherein the USLEDs are programmed from an optical source array (generally a matching, or a superset, of the target USLED array) which programs a position address into each USLED on the target array. After programming, each display element retains, such as in FLASH memory, the address within the array that it is to be responsive to. A display array which is implemented according to the present invention contains a collection of programmable display elements, such as USLEDs, which are attached to a surface or backplane containing a power plane and a ground plane. During operation of the display, a drive voltage is applied between the power and ground plane that contains a superimposed serial APA control signal. The APA control signal comprises cycles within which, one or more data bits are contained for each element. A simple On/Off element requires only a single bit of intensity data while an RGB element may utilize twenty-four or more bits for color and intensity selection. Each display element monitors the serial signal pattern on the backplane and it receives its operating instructions at the address within the signal. Thereafter, such as at the end of a signal cycle wherein every display element has received a command, the display elements commence to display the desired state, by utilizing power from the backplane and modulating their own intensity/color based on the information received in the serial signal on the backplane. It will be appreciated that a display may contain display elements which are connected to receive different serial signals, so that the update rate of the display may be increased or to match certain signal receipt characteristics. For example, a large color display may incorporate different colors of elements, such as Red, Green, Blue, which may each be connected to a different power and signal plane within the backplane so that the update rate of the entire display can be tripled. It will be appreciated that the display elements may be divided in different ways from separate signals without departing from the teachings of the present invention.

Each display element, such as a USLED, preferably contains power conversion circuits to decode digital signals from the APA signal which are superimposed on the supplied power voltage. It will be appreciated, however, that one or more signal planes may be utilized that are separate from the power planes, although the complexity of the backplane may be significantly increased. The signals from the backplane are preferably decoded into an intensity (bit) clock, a column clock, a row clock, and a cycle reset. Alternatively, the addressing may use an absolute address instead of the row and column format and may incorporate the intensity clock within the absolute address. Additional addressing clocks may be added, if desired, to support three or more dimensions of addressing. Within this embodiment, the DC component of the applied drive voltage may be at either a normal operating voltage level, such as 6 volts, or at a programming voltage level, such as 12 volts; the voltages being preferably available separately within the circuit. From the applied power with superimposed signal, each USLED thereby extracts clocking signals to drive one or more internal counters. When the value of the counter matches a stored USLED address, the USLED then clocks in a predetermined number of bits framed on the intensity bit clock from the APA control signal. Preferably, the bits are stored until the end of the APA control signal cycle at which time they are latched as output to the display elements, such as LEDs in the case of the exemplified USLEDs. It will be appreciated that the relationship between the counter value and a stored address value need not be one of matching; only that there be a unique relationship such that each USLED may be individually addressed (e.g. could use subtractive, complements, and so forth). The technique is well suited to providing redundant displays of information, such as two sides of a display panel, with the same APA control signal, so as to reduce the necessary electronics within redundant displays. The USLEDs of the redundant portions of the display are simply programmed to the same address.

For display elements which are driven at various intensity levels, the multiple bits of latched output are employed to control a digital or analog intensity control for the output element. An intensity control may be implemented utilizing a number of methods, such as a weighted MOS FET ladder (simple current mode D/A converter), or a counter loaded from the intensity value such that duration of activation of the LED is determined by the loaded intensity value. It will be appreciated that "gray-scales" of any element may be produced by using the simpler On/Off control of each element while and toggling between on and off states so as to achieve a desired level of brightness; however, this method is less preferred as it incurs a burden on the control software.

It is anticipated that the universal display elements according to the present invention may be produced in a variety of shapes, sizes, and colors, with both monochrome and various multicolored elements being produced. The design of the display elements can allow these units to be mixed within a single display array. For example on a large advertising display a square region of tri-color (RGB) elements can be located within a field of grayscale single or dual color elements. The APA control signal electronics lend themselves to this form of mix and match, wherein each type of element is capable of extracting from the APA signal the proper drive signal for its own display type.

Although the addition of a circuit to each LED, or LED cluster, to create a USLED will initially raise the cost of the individual LEDs, however it is anticipated that once the production methods get well established and the quantity ramps up that the added cost per element will not be significant. The universality of the USLED and the elimination of the costly drivers, and backplanes, along with the reduction of troubleshooting expense will create overall reductions in the cost of the produced display arrays.

The preferred method of programming the addressing for the USLEDs is with an aspect of the present invention referred to as in-situ optical programming. A photodetector within each USLED is capable of detecting the presence of light. This photodetector preferably utilizes the PN junction of a/the display LED in either forward or reverse mode. An array of unprogrammed USLEDs are first attached between power and ground which is connected to an APA controller. The APA controller is also electrically connected, preferably through a voltage drop, to a preprogrammed array of USLEDs which is called a programming array. The programming array utilizes a set of programming USLEDs which are adapted USLED circuits for use in programming. A programming mode for the controller is selected wherein the controller outputs a signal corresponding to a slow-scanned moving active cell, wherein a single moving LED on the programming array traverses a fixed pattern, such as down each row in turn. The programming array is optically coupled to the unprogrammed array, such that light from each USLED of the programming array can be coupled to only one USLED of the unprogrammed array. It will be appreciated that should the arrays be optically-coupled face to face, then the preprogrammed USLED array should be programmed as a mirror-image of the addressing for the array being programmed. The unprogrammed array is receiving power with the APA control signals, but no LEDs are being lit as the address is not yet programmed and therefore no count matches occur. In programming mode, the APA controller is set to generate the APA control signal superimposed on a programming voltage, however, the preprogrammed display by virtue of the voltage drop, or other adaptation, remains in normal display mode and is not reprogrammed. With the programming voltage present, the USLEDs continue counting the APA control signal with the count being reset each cycle of the APA control signal. When a sufficient light level impinges on a USLED which is in programming mode, then the counter value is programmed as an address into a non-volatile memory within the USLED. The non-volatile memory may be in the form of FLASH cells, OTP cells, or alternative non-volatile storage. It will be readily understood, therefore, that each USLED is being programmed to match up with the operation of the programming array. Furthermore, once the new display array is programmed it may be given a test pattern, wherein the optically coupled programming array is utilized as a light detection array to register that each display element within the new display array has been properly programmed and operates correctly.

To replace a faulty USLED within a programmed array, a technician can easily program a new USLED for the proper row and column. A portable battery operated programmer can be produced from an APA controller, a single programming USLED circuit, and a row and column selection device. The unprogrammed USLED is connected, the proper address is set and the program button is pressed. The USLED is ready to be inserted into the array. Alternately, preprogrammed USLED could be obtained wherein the service person specifies the address desired. It will be recognized by those in the industry that the inventive system described should exhibit increased reliability over current display arrays, and that it should be possible for untrained personnel to repair the displays due to the elimination of the complexity of row and column diagnostics.

Another of the methods of USLED programming according to the invention requires the use of a one-time programmable non-volatile memory which does not require an extended programming voltage, but only a load pulse. Within this arrangement the programming voltage is eliminated but an extra bit of the non-volatile memory is added to contain the program state of the USLED. A new USLED thus starts with this bit set to a state of "unprogrammed". When power is applied, the USLED in the unprogrammed state does not output any light but senses light from the photodetector (preferably one of the same LEDs used to generated light output), and the non-volatile memory (NVM) is loaded in response to a light input. When the NVM is loaded, the state of the program state bit is toggled to "programmed". When in programmed mode the USLED is only capable of generating light and can not be further programmed.

It must be appreciated that variations of the invention can be implemented without departing from the methods of the present invention. Specifically, the USLEDs may be programmed without use of the aforesaid in-situ optical programming technique. As an alternative the USLEDs may be programmed to fixed addresses prior to insertion into the array, or configured with a programming pin through which in-situ programming may be performed. However, the simplicity of replacing a faulty USLED in the field will be lost in many of these variations.

Preferably, the circuitry according to the present invention is incorporated within the display element itself so that a single universal scanning element is created. The techniques and described circuitry can be used with any form of display element such as LEDs, laser diodes, infrared diodes, incandescent lights and so forth. The circuitry may be incorporated within the die of a display LED, or it may be provided as an integrated circuit die to which one or more display elements is bonded such as by a "Flip-Chip" method, or another such means. The circuitry of the present invention would thereby become a carrier for the display element (one or more LEDs) which would then be encased within the optical housing which may appear as a typical LED. Alternatively the chip could be bonded to a substrate to which one or more elements is connected, such as three separately housed RGB elements or an incandescent light. In considering the use of modules having three separate elements connected to individual display elements: it will be understood that since the elements are not constrained to conventional row/column addressing, RGB elements may be placed in proximity within the array and addressed non-consecutively such that each may be addressed as a color plane (i.e. reds addressed as 000h,000h to 01Fh,0FFh; greens addressed from 020h,000h to 03Fh,0FFh; and blues addressed from 040h,000h to 05Fh, 0FFh). Configuring the addresses in this manner simplifies the task of the display system software to convert an image for proper display and may eliminate the impetus for using modules containing multiple elements. It should also be appreciated that LEDs may now be fabricated on substantially conventional silicon dies, wherein the display element and the drive circuits share the same single die. Therefore, it will be recognized that the cost of integrating control electronics within the display element is being increasing driven downwardly by technological advances.

An integrated circuit form of the described circuitry would preferably contain configuration options and test connections. For example, the universal scanning circuit may be bonded to LEDs as display elements or as a programming LED. In addition access should be provided to critical circuit areas for chip testing. controller in a direct (non-multiplexed) operation. However, display multiplexing, as generally shown in FIG. 1, was introduced to overcome the difficulty with providing individual signals for each element of a large array. Basically, in a multiplexed display each display element is connected across a row and a column, such that any element may be enabled, or lit up, by providing power on a column while pulling one of the rows to ground. By quickly scanning across the rows and columns each element can be individually driven for a small duty cycle. Multiplexing reduces the number of control lines necessary but results in a commensurate loss of maximum output intensity. It will be appreciated that each display element may only be driven for a small percentage of the time, depending on the depth of multiplexing utilized, and the achievable display intensity is therefore reduced. In the array of FIG. 1 it will be appreciated that power to one column may be applied wherein current sinking by the row driver activates any LEDs in that column, wherein each LED can be activated for a maximum of ⅙ of the total time as there are a total of six columns which are being driven. In displays requiring greater intensity, such as outdoor displays, the depth of multiplexing must be reduced and many displays utilize drivers for each display element.

An object of the invention is to provide for the production of display arrays that do not require a complex backplane with conductive pathways or drivers for the rows and columns of display elements.

Another object of the invention is to provide a simplified method of driving display arrays that may comprise single or multiple axis arrays of elements.

Another object of the invention is to provide a simplified method of driving display arrays that may comprise elements configured to display one or more intensities and/or colors.

Another object of the invention is to provide a simplified method of driving arrays of display arrays for animated displays.

Another object of the invention is to reduce the production cost of production quantity display arrays.

Another object of the invention is to reduce/eliminate the engineering cost involved with the creation of custom displays.

Another object of the invention is to allow the use of full intensity within the display elements so that brighter displays may be created and higher contrast ratios supported.

Another object of the invention is to provide a set of universal display elements from which displays of any configuration, shape, or form factor may be created.

Another object of the invention is to provide a standard display element which is fully scalable to any size, and is compatible with a variety of display element types within the same display.

Another object of the invention is to provide a display in which the operational relationship of the elements does not depend on a physical relationship, such as the row and column traces of a conventional display.

Another object of the invention is to provide a display array in which elements or areas within the array can be randomly accessed and loaded with new display settings while the remaining elements continue displaying information loaded from a prior cycle.

Another object of the invention is to provide a display array in which reliability and serviceability are greatly enhanced, due to the elimination of complex backplanes and driver circuitry.

Another object of the invention is to provide displays which can be controlled from a standard controller—with no need to create custom electronics and firmware for each unit.

Another object of the invention is to provide a mechanism whereby field repairs of a display unit may be carried out by an unskilled technician in a minimum of time.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DETAILED DESCRIPTION OF INVENTIVE EMBODIMENT/S

Referring more specifically to the drawings, for illustrative purposes the present invention is embodied in the apparatus generally shown in FIG. 2 through FIG. 10B. It will be appreciated that the apparatus may vary as to configuration and as to details of the parts without departing from the basic concepts as disclosed herein.

Figure 1:
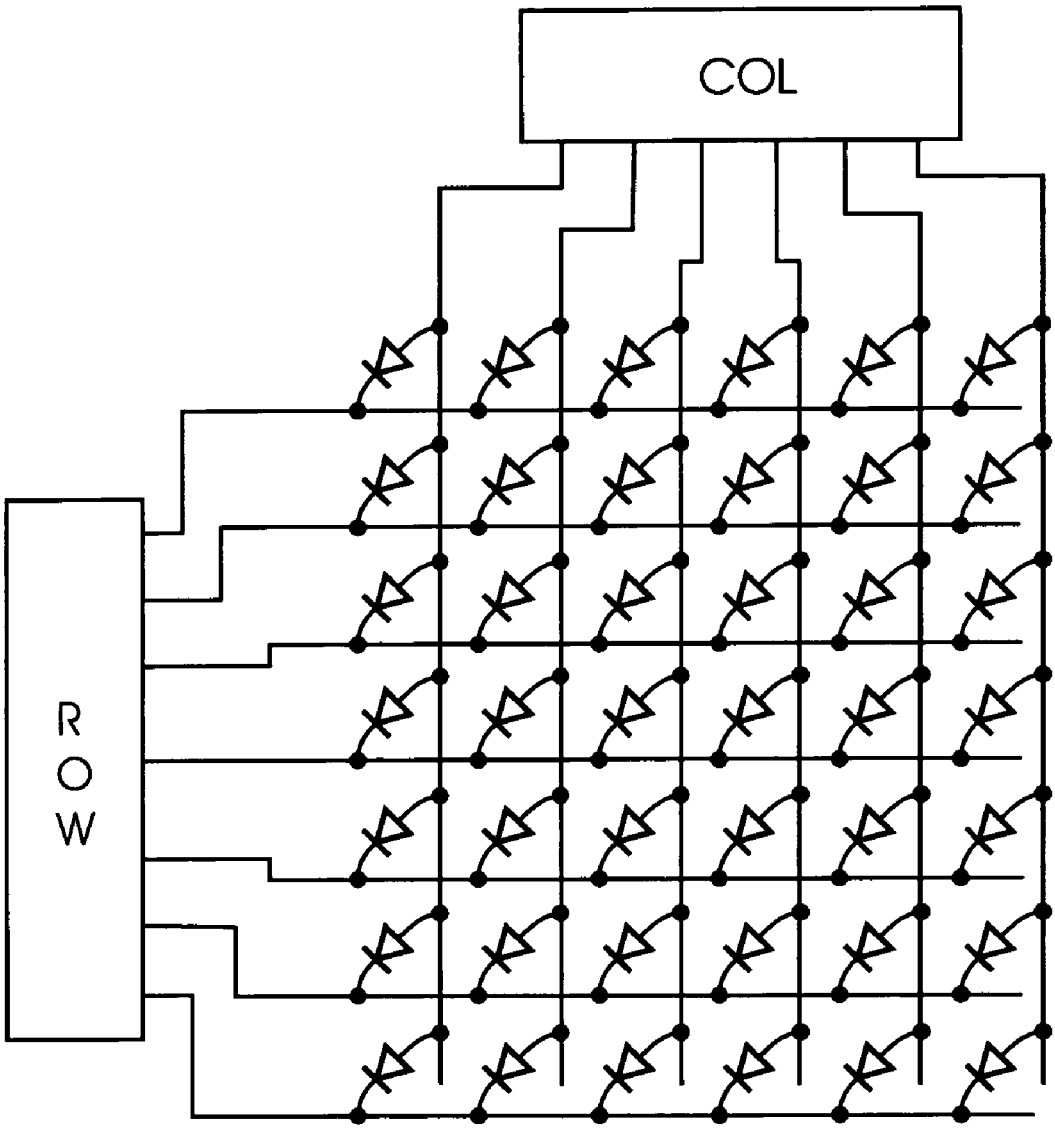
FIG. 1 ( Prior Art )
FIG. 1 is a block diagram from a conventional multiplexed LED display array, showing six columns and seven rows of LEDs that may be drive.
Figure 2:
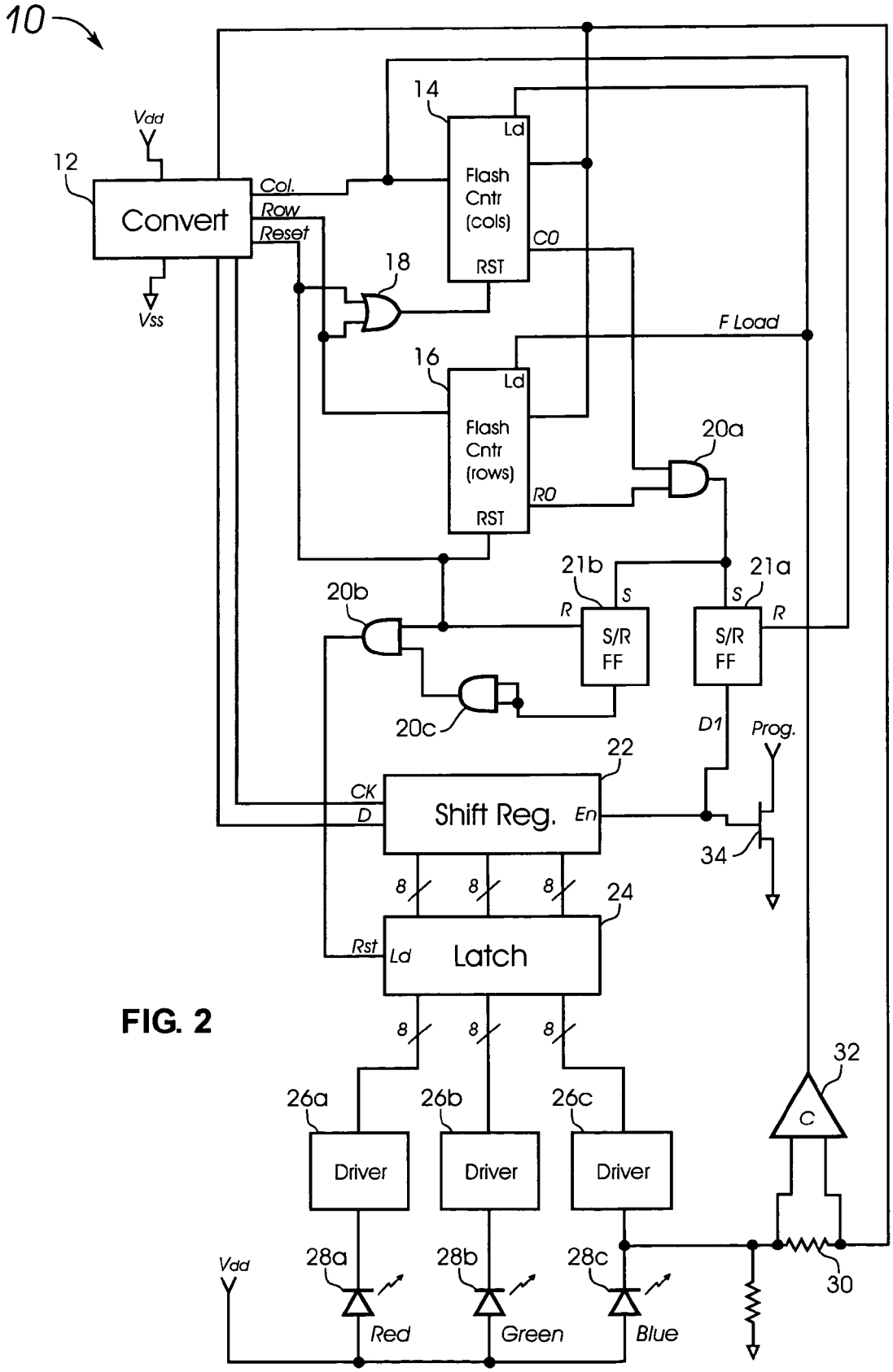
FIG. 2 is a schematic of an embodiment of a USLED according to the present invention, showing a RGB USLED designed for in-situ optical programming.

One embodiment 10 of a USLED is exemplified in FIG. 2, having been integrated with a red, green, and blue LED display element. The power received by the USLED contains superimposed control signals which are extracted by a conversion circuit 12. The embodiment shown utilizes four embedded signals, an intensity clock, a column clock, a row clock, and a reset signal. These signals are embedded on the power bus using any of numerous conventional data encoding techniques, which may utilize reversing bits, bits of differing amplitude or phase. This embodiment is shown configured requiring the use of a programming voltage when programming the non-volatile memory within the circuit.

Generally speaking, the clocks are used to drive circuit counters within the universal scanning element that define intervals for the intensity bits, the columns, and the rows of the display. The reset signal is generated at the end of each cycle, after each active display element has been programmed, and it resets all the counters to an initial state and also triggers the change of state of the display to the newly loaded pattern. With each count of the column counter, the address shifts one column position in the array. A row clock is generated at the end of each row of elements, and it causes the row counter 16 to advance and the column count to be reset through OR-gate 18. It will be appreciated that the column counter could overflow to accomplish a similar function, however, using a row clock allows the USLED circuit to be designed to support a very large row length even if just a portion of that row is populated with display elements. An objective of the invention that should continually determine the preferable arrangement for the circuit is that of creating a substantially universal circuit which may be used within the display elements of any display array.

The counters 14, 16, contain non-volatile memory (NVM) cells that are programmed to an address for the specific USLED within the array of elements. As the count of columns and rows advances, it is continually compared with the address loaded in the memory cells. Upon a match being made of column and row the output of gate 20*a* sets the S/R flip-flops 21*a*, 21*b*, which enables the shift register 22 so that it begins clocking in data bits framed by the intensity bit clock. Upon arrival of the subsequent column clock, the shift register is disabled and statically retains the intensity bits for this USLED. This particular USLED has red, green, and blue elements each having 256 levels of brightness, so that twenty-four intensity bits are utilized, which are clocked into the shift register 22 from the intensity clock being extracted by the converter 12. It will be appreciated that the USLED circuit shown may be used to drive a single LED with up to 256 intensity levels as the relationship of the number of intensity clocks between column clocks determine how many bits are stored to define the intensity. For a single LED a total of eight intensity clocks would be preferably generated between each column clock. Display elements, single, double, or triple, may be mixed within the same array of elements when the APA generates clocking according to the deepest clocking necessary for any element.

The data in the shift register 22 is retained until all the USLEDs in the panel have been addressed at which time the APA controller generates a reset signal. The reset clears all the counters and triggers the loading of a latch 24 from the shift register 22. The output of latch 24 is set according to the updated data and signals are provided to drivers 26*a*, 26*b*, 26*c*, for each of the corresponding LEDs 28*a*, 28*b*, 28*c*. These drivers provide current mode D/A converters for the LED being driven, and may be implemented in various configurations according to present practices. It will be appreciated that the intensity of the LEDs may be equivalently driven by altering the amount of time they are activated within a particular display cycle, therein counters would be utilized instead of D/A converters.

Since the change in LED state may be accompanied by sizable overall current changes within the array, the reset signal is preferably generated twice in succession. After the first reset, the reset is sent again after a delay and to again clear the counters. The S/R flip-flop 21*b* provides qualification of the reset signal so that only the first reset signal clocks data into the latch. The prequalification prevents spurious data from being latched if noise from the transition were to trigger a row and column match and an intensity clock signal. This simple precaution adds additional security to prevent false display settings, as no display reading can be latched unless a valid address match occurs during the APA cycle. The prequalification also allows the use of random addressing wherein only the sections of the array which have changed need to be updated with new display data. In addition, faulty display elements are constrained to "showing up" as unlighted elements, rather than displaying "garbage" which could be difficult to discern from proper operation (garbage could follow an all elements ON or OFF diagnostic display). When the first reset arrives, the S/R flip-flop 21*b* should be in a set state if this USLED was addressed during the cycle, which should be true on each cycle. The output of flip-flop 21*b* is ANDed with the reset signal to drive the load input of the latch. The reset signal also resets flip-flop 21*b* to a reset state. The AND gate 20*c* provides an additional propagation delay to lengthen out the load pulse whose length is determined by the race condition of the signals to AND gate 20*b*.

Reset is generated by the APA controller on the power bus after all active elements have been loaded; however, as not all defineable positions are generally populated, the reset will typically be generated as soon as all addressable elements have been programmed, so that a subsequent cycle may commence. The USLED circuit can therefore be implemented to accommodate very large display sizes but the same circuit may be used with small circuits without losing efficiency or compromising the update rate. It is expected that USLED circuits will be specified for operation within a given frequency range, as given by the clock rates, and designers can then configure the APA controller speed to suit the needs and size of the array, or vary the clocking rate within a specified range to accommodate the necessary update rates for the display.

Loading of all display elements has been described in the preceding section, however, it should be appreciated that a form of random addressing may be performed. If only one section of the display needs to be changed, then after the prior APA signal cycle is complete, the row count can be incremented, without the need of supplying column counts or intensity data, until the proper row is selected after which column counts may be given without data to arrive at the selected area to which data is then loaded. After loading the data to the selected area, the addressing may continue to another area, or the reset signal may be generated to get the addressing back to the origin. The elements which have not received new data will continue to display the data contained within the intensity data latch (reset pulse will not reload latch as no address match was made during the cycle). This form of random addressing allows a slower overall clock cycle, yet the display can be updated quickly for better animations.

It will be further realized that the APA controller can be configured for the capability to operate at various frequencies so as to reduce RF noise and circuit power consumption. Preferably, the signal extraction circuitry of the USLEDs will be capable of maintaining reliable signal extraction over a wide range of operating frequencies.

The receiving and displaying of data by the USLED has been described according to FIG. 2, wherein the addressing and data provided by the APA controller were used to set the state of the display(s). However, the mechanism utilized within the embodiment for setting the address of the particular USLED has not been described. The embodiment of FIG. 2 utilizes in-situ optical programming wherein the address of a particular USLED is determined by pulsing a light to the USLED when the desired address to which the USLED is to be programmed appears on the power bus. It will be recognized that PN junctions are sensitive to light in both forward and reverse directions, which makes the use of the output LED as an optodetector a logical, and inexpensive, choice. A simplified diagram of light detection is shown in FIG. 2. Current flows though resistor 30 through the back-biased diode when the program voltage is provided to the circuit. The amount of the reverse current flow depends on the amount of light impinging on diode 28*c*. The comparator 32 registers the current and its output is triggered when sufficient light is detected. The output of the comparator drives the load signal for programming the non-volatile memory of the counters to the current count value. An alternate LED driving FET 34 is shown which allows the universal scanning circuit to be used within an optical programmer, as it generates light output only while the element address is active.

Figure 3:
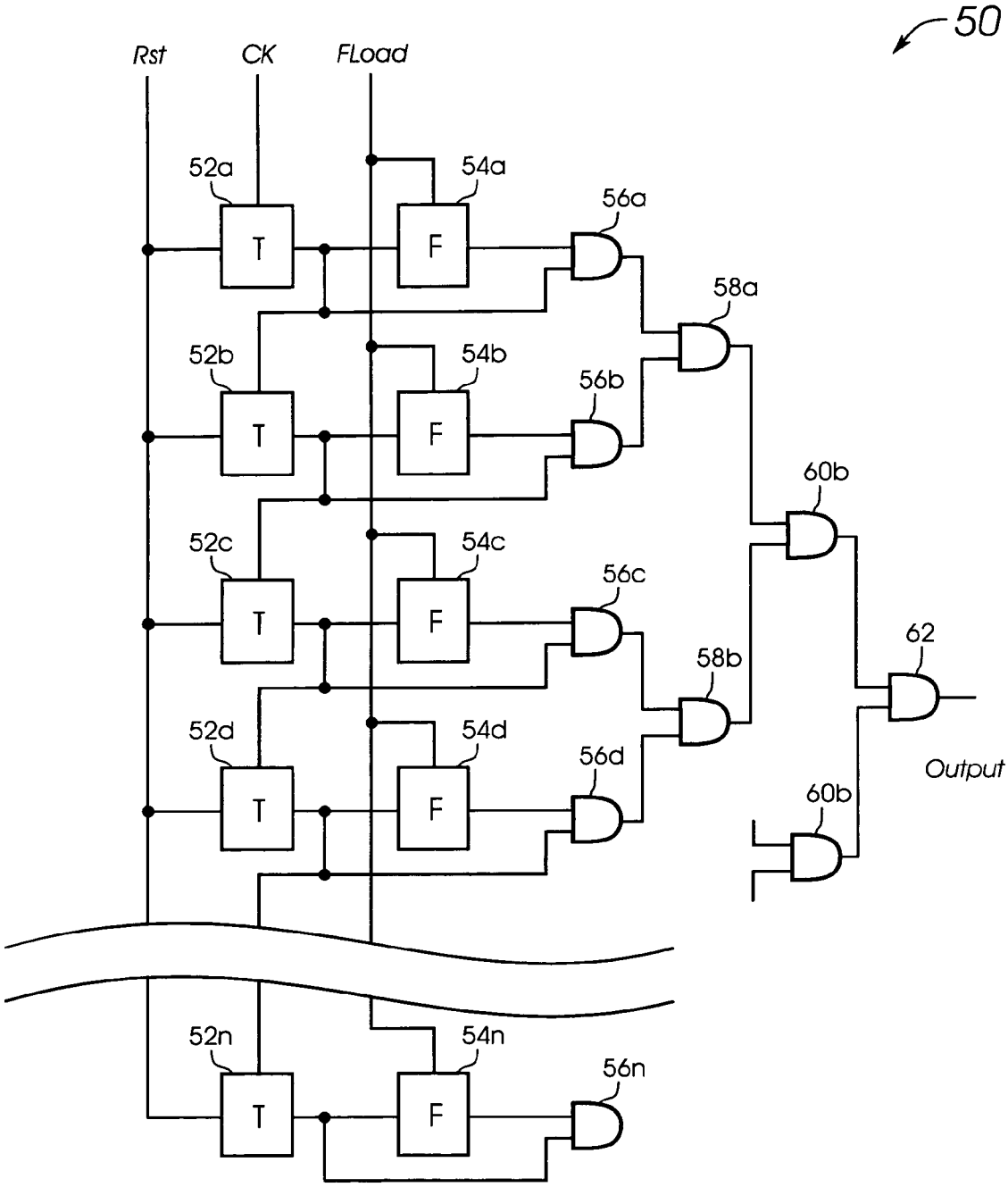
FIG. 3 is a schematic of a counter according to one aspect of the present invention, which compares a count value with a programmed address.

FIG. 3 is a diagram 50 of a representative counter containing non-volatile memory and a matching circuit. A series of toggle flip-flops 52*a*-52*n* are shown in cascade which receive a common reset signal. The output of this binary counter is received by non-volatile memory cells 54*a*-54*n*. The outputs of the memory cells are always active and are compared with the output of the counter via levels of gating represented by gates 56*a*-56*n*, 58*a*-58*b*, 60*a*-60*b*, and 62. Only a portion of the counter circuit is shown in FIG. 3 as it may span numerous levels. Upon receiving a load pulse (when the programming voltage is set to high—connection of programming voltage not shown), the data being output by the counter is loaded into the non-volatile memory which sets the address for the USLED. This allows address programming to be performed in-situ after the array of display elements have been assembled onto a power plane backing. Preferably optical programming is performed after assembly, wherein an array of programming USLEDs with a similar pattern (which has been programmed already) is optically coupled to the unprogrammed array by placing it over the display with cylindrical tubes from the programming array encircling the optical elements of the target array, so that maximum light is coupled to it. The programming USLEDs are configured to generate an intense light immediately upon address match, and the circuits may be produced using the same universal scanning circuit to which the LED had been alternately connected, as exemplified in FIG. 2 by FET 34. It is possible to use a single APA controller to generate the signals for both the unprogrammed and programmed display (with the programmed display having been programmed to the reverse image of the desired programming of the target display).

Figure 4:
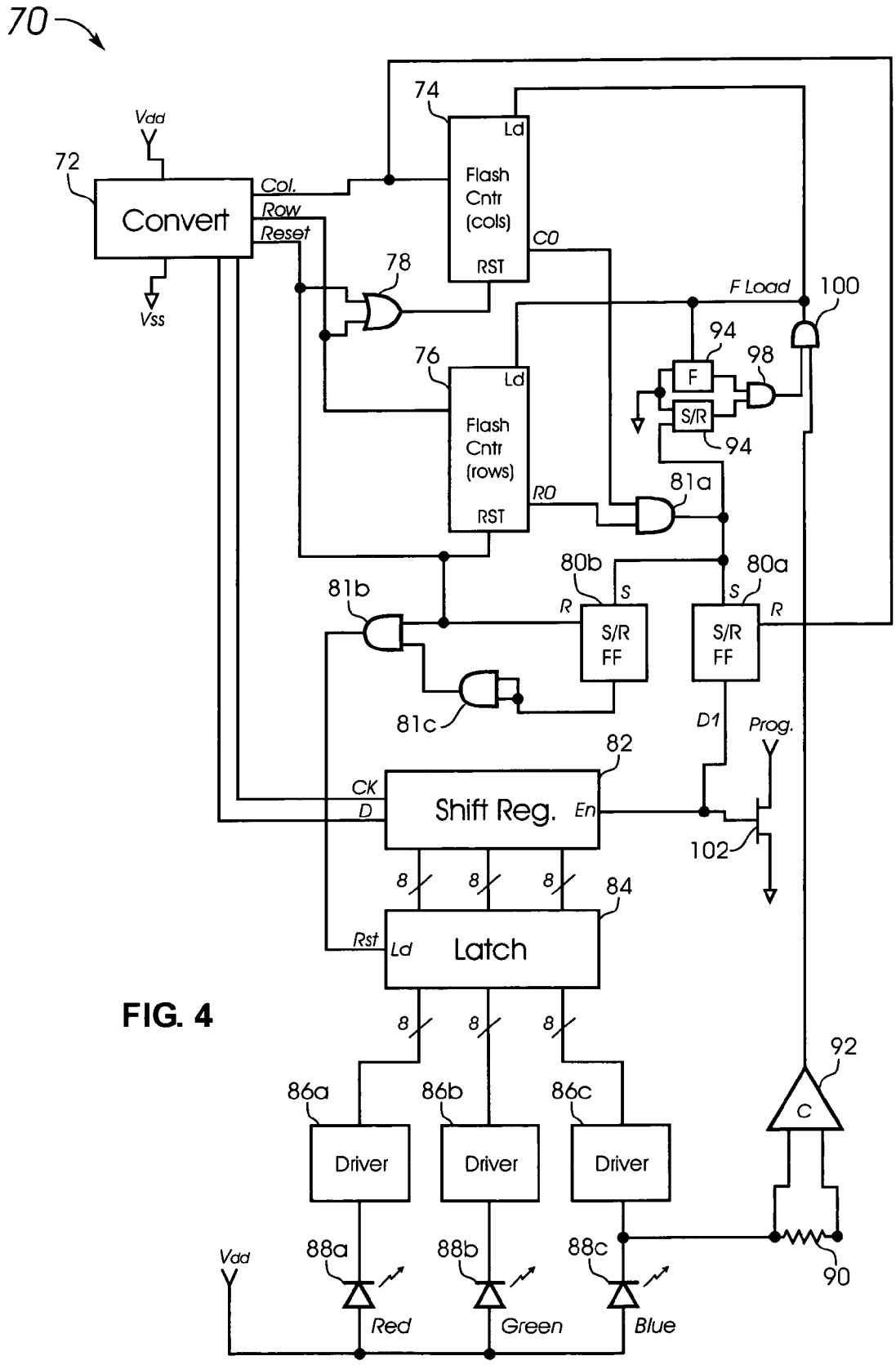
FIG. 4 is a schematic of an embodiment of an RGB USLED according to the present invention, showing a programming qualification circuit.

FIG. 4 contains another embodiment 70 of an RGB USLED whose non-volatile memory does not require a high voltage programming level to initiate programming of the device. To control the programming of the element, a non-volatile memory cell was added 94, which is initially in an unprogrammed "1" state. An S/R flip-flop 96 is connected so as to power up in a reset state. When the counters are unprogrammed their non-volatile state is set to all ones which corresponds to the last address possible for the APA control signal (an address not populated by a display element). To prevent the USLED from getting accidentally programmed, a preprogramming step provided wherein the APA cycle is extended up to the highest address wherein all unprogrammed USLEDs are selected (with data=0). This selection is performed once the system is ready for programming and established in optical connection with the programming display wherein no extraneous light can inadvertently trigger loading. The selection activates the set line of S/R flip-flop 96 to preselect the device for programming. At this point each USLED device will be programmed upon encountering a light pulse. As sufficient light is received, comparator 92 generates a program signal. Since the non-volatile memory is set to all "1s", the cell 94 is outputting a 1 which indicates unprogrammed. Combined with the output of the S/R FF, the programming signal is gated through to load all the non-volatile memory (counters and the separate cells). Once programmed, cell 94 is set to "0" such that the USLED can not be reprogrammed.

Figure 5:
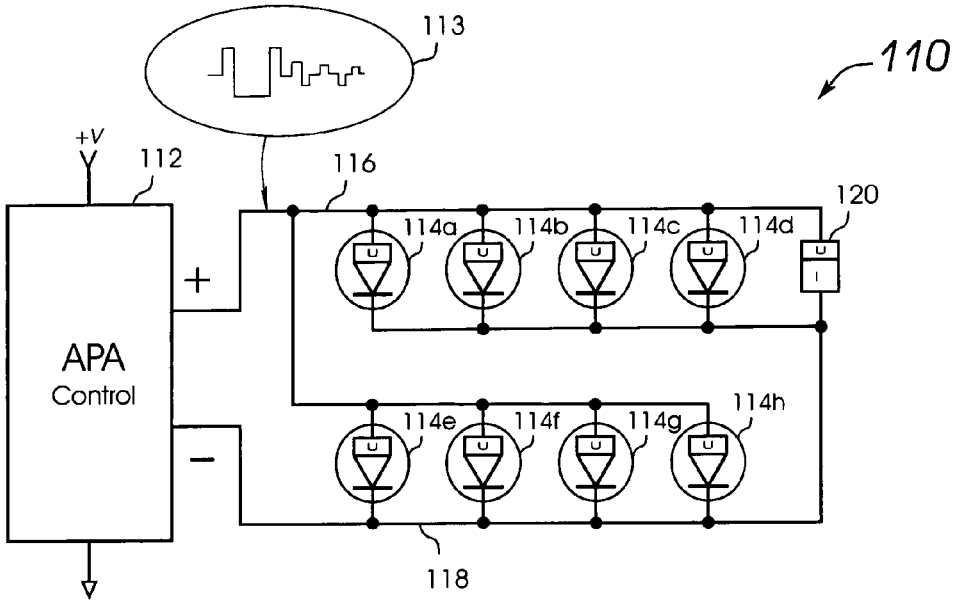
FIG. 5 is a schematic of eight USLEDs and an APA ballast connected to an APA controller according to an embodiment of the present invention.

FIG. 5 shows an array of USLEDs connected to an APA controller, although the number of elements is very small for an array (eight) it represents the connections necessary to construct a display array according to the present invention. The USLED are schematically shown connected with a trace, however, it will be understood that in general use a planar region is preferred. An APA controller 112 is shown with a power connection and having a two-wire output. A signal 113 is shown encircled as representative of the APA signal which shows large square wave pulses for reset and pulses for the column and row clocking. A positive voltage connection 116 and a negative voltage connection 118 are made to each of the USLEDs 114*a* through 114*h*. It will be recognized that the symbol shape for a USLED provided herein is given by a diode symbol having an additional rectangular box which in this case contains a "u". Additionally, an APA ballast element 120 is shown on the power bus. The ballast 120 is an optional element for use in large arrays which is capable of minimizing current fluctuations on the power bus and its optional use will be described later. It should be appreciated that the display array has but a two wire controller and a series of USLEDs connected between power and ground, there are no row or column traces, nor drivers, to contend with.

Figure 6:
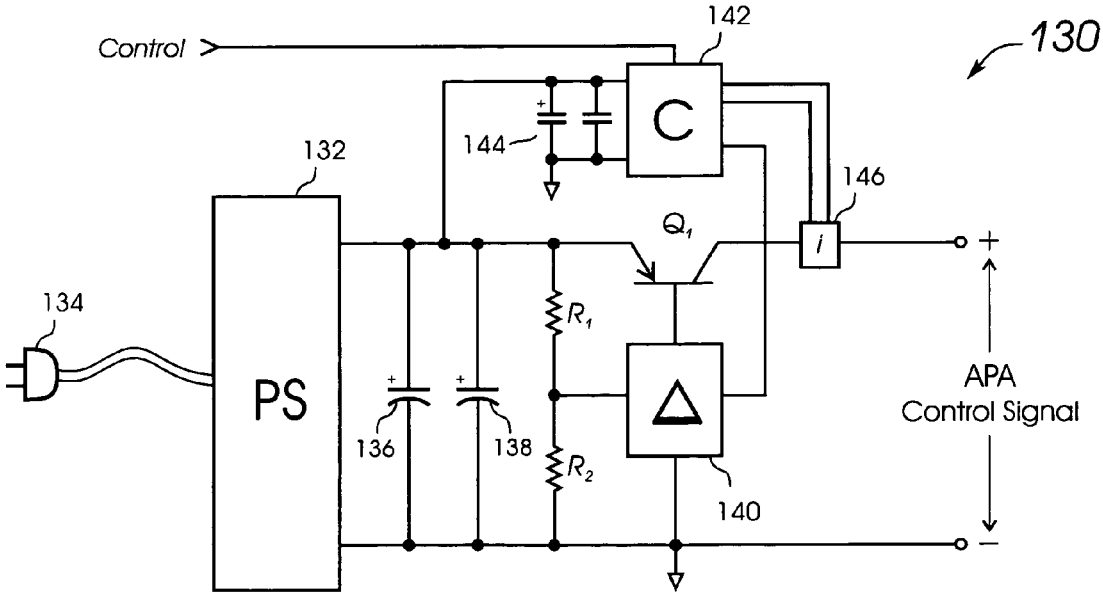
FIG. 6 is a schematic of a representative embodiment of an APA controller according to an aspect of the present invention.

FIG. 6 is an APA controller 130 according to an aspect of the present invention. A conventional power supply 132 accepts power from a source, in this case a 110 VAC wall outlet 134. The output of the supply is well filtered by capacitors 136, 138. A modulator 140 is controlled by a microcontroller chip 142 that is executing instructions to control the display. The modulator 140 is capable of altering the conduction of pass element Q1 so as to impose a small signal on the output as the APA control signal. The microcontroller chip 142 is supplied from the power supply and fitted with bypass capacitors 144.

A current sensing element 146 is optionally provided for use in detecting faulty operation, such as a faulty element within a driven array—wherein the elements are driven as one per cycle and the current is measured. Elements whose current draw fall out of range are suspect and should be checked. To simplify the isolation of faulty USLEDs within a large array, this fault finding mode of the APA controller may be selected. Such current sensing is possible because unlike multiplexed displays, the entire array is capable of static operation, such that with a single display element active the clocking can be suspended, such that all circuits are only drawing a minimal (measured) quiescent current, and the current draw of a single display element can be detected as an increase corresponding the active display current. A single display element is selected and the APA stretches out the timing cycle during an address (the circuitry is then all static and drawing meager power) to allow a proper measurement of current level to be made. If the current level is outside of the normal range, then the controller can display the row and column of the suspected faulty LED as a row and column number, or by encircling the suspect LED with lighted elements and toggle the suspect LED on and off so the technician can check if it the display element is indeed faulty. If the element is faulty then the technician can replace it on the spot. In large displays, a remote control for the display array is preferably used which provides RF communication between the technician at the display and the APA controller, as well as allowing new USLEDs to be programmed on the spot. The APA controller can even transmit the suspected address to the remote so that the technician need only plug an unprogrammed USLED into the controller and press the button and the new device is ready for insertion to replace the device being encircled on the display by the APA controller. This mode can continue until all faulty element have been reported. This testing mode may also be entered for few cycles (testing a few LEDs) during screen blanking intervals so that over a period of time all LEDs are being tested with a report being selectively generated on demand, or at intervals.

In considering the supply noise generated by the circuit elements it will be appreciated that all USLEDs within the array are in a static state during a cycle of APA control signal. The LEDs being driven are allowed to transition from one intensity level to another only after receiving the reset signal. The reset signal preferably comprises duplicate cycles, such that the first cycle resets the counters and commences the state transitions of the LEDs, or other display elements, while the delayed second transition occurs after the power bus has stabilized, and it again resets the counters in case any glitches caused by the transition. After the second reset signal, the current being drawn from the power bus is again stable at a fixed current level and thereby the APA signals riding on the power bus are unaffected. The power bus on which the USLEDs are mounted will be preferably implemented with a low impedance, which should be easily attainable as a power plane and a ground plane since no other signal traces need to be incorporated.

If the power supply itself is unable to stabilize in a short enough interval then measures can be taken to mitigate the current transition. One aspect of the invention allows for adding programmable ballast devices distributed on the power bus. These devices are similar in structure to a USLED element, but instead of having a display element they are configured with the driver as shown in FIG. 3 shorted to ground so that a programmable load may be added to the power bus. It will be appreciated that such a ballast load can employ the same control circuit as used within a USLED but preferably with a bondout change so that the driver can source a high current that is equivalent to the current of numerous USLEDs (50-200) and packaged differently to suit their dissipation and for allowing them to be mounted without disrupting the configuration of the display array. These ballast loads can be distributed on the power bus (they can be on the backside, or between array elements as they need not have same form factor) and will be programmed by the APA controller each cycle to maintain a balanced current draw from the power supply. The addresses for these APA ballasts are preferably set at a fixed set of addresses within a particular row, such as near the end of the last row, (just prior to the last address which is for preprogram selection) so as to allow common use within a variety of devices. With fixed addresses, the ballasts need not be programmed, only inserted on the bus and properly controlled by APA controller which can estimate the change of current and program the ballasts to maintain a substantially stable current draw. The design of APA ballasts could become quite sophisticated, and another embodiment of APA ballasts could provide a load that acts as the above load, but with another driver that acts to snub the current change by drawing an initially high current, then tapering the current draw off slowly. It will be recognized that using a tapered current draw would lower the overall dissipation of the system and allow setting a current equilibrium point at a lower level to maintain balance. Regarding the foregoing description of APA ballasts; it must be understood that such devices should not typically be necessary, but are provided as optional components of the system which may be used in selected instances, such as for reducing the cost or complexity of the power supply system.

It should be appreciated that very large displays may be broken down into a series, or an array, of smaller displays, to support a larger number of elements than can be supported within a single array. Multiple APA controllers are therefore utilized in concert to control these separate areas of the display under the control of a master controller which sends the appropriate information out to each of the separate APA controllers.

Figure 7:
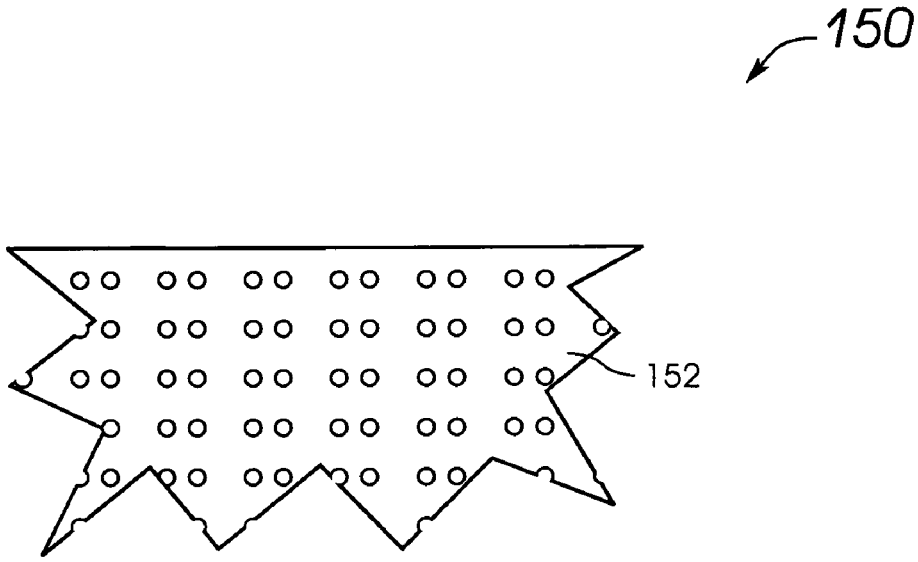
FIG. 7 is a section of a base member capable of supporting an array of universal scanning elements according to the present invention.
Figure 8:
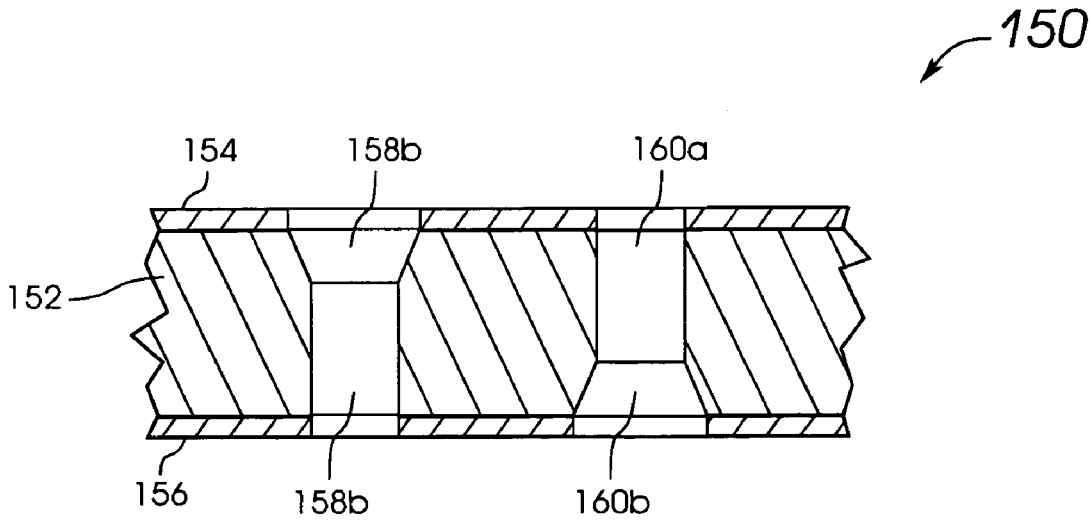
FIG. 8 is a cross-section of the base member of FIG. 7, showing the holes for mounting a display element.
Figure 9:
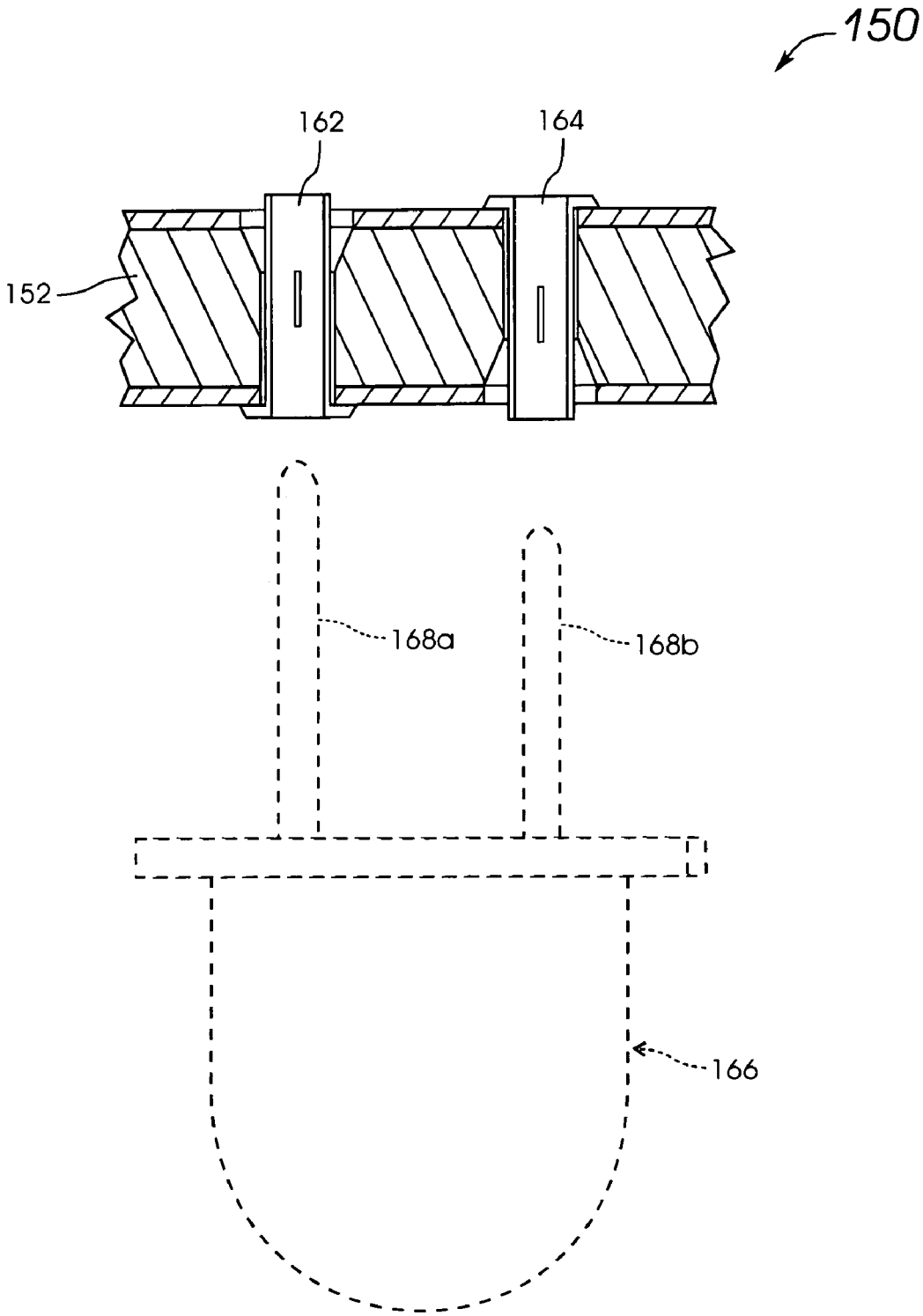
FIG. 9 is a cross-section of the base member of FIG. 8, adapted with inserted connectors for which a universal display element is positioned for insertion.

The method and system of the invention allow for new display array uses, production methods, and troubleshooting. Numerous methods of producing display arrays are anticipated by the present invention since the complex backplane replete with distributed drivers can be replaced with simple power and ground connections. These power and ground connections may be provided by a single pair of wires, such as to form a single-axis display array, or as interconnected wiring, traces, or backplanes to form one or two-axis arrays. Backplanes may be easily configured in the present invention through which sufficient current and signal may be supplied to the display elements. Sheets of nonconductive material, such as aerated plastic (light weight nonconductive material), can be formed with conductive opposing faces to carry the ground and power planes. A representative structure 150 is shown in FIG. 7 through FIG. 9. A base material 152 would preferably be thick but compliant and light with integrated connectors. The plastic base material 152 is shown metalized on both sides 154, 156, by conventional processes, such as sputtering, painting, or laminating. Holes 158*a*, 160*a*, with tapered reliefs 158*b*, 160*b*, in FIG. 7, are cutout from opposing faces so as to allow the inserted connectors 162, 164, as shown in FIG. 9 to contact only one conductive face of the material. A USLED 166 with leads 168*a*, 168*b*, is shown in preparation for insertion within the connectors 162, 164. The leads of the USLED are shown as conventional square LED leads, however it will be recognized that the material can be configured with various forms of connectors, such as bayonet, screw-in, and similar. The material shown is preferably at least ⅛ inch thick to provide a large contact surface with the USLEDs (multiple wipers) and to properly support the USLEDs as perpendicular to the base material. It will be appreciated that such a structure can be cut to any desired shape, populated with USLEDs, connected with a APA controller, and programmed, so as to provide a display array suitable to the application. It will further be appreciated that the base material of the array may be curved or bent to suit the application. The base material may also be formed, or molded, into any desired shape to which the array of USLED will be attached.

Figure 10A:
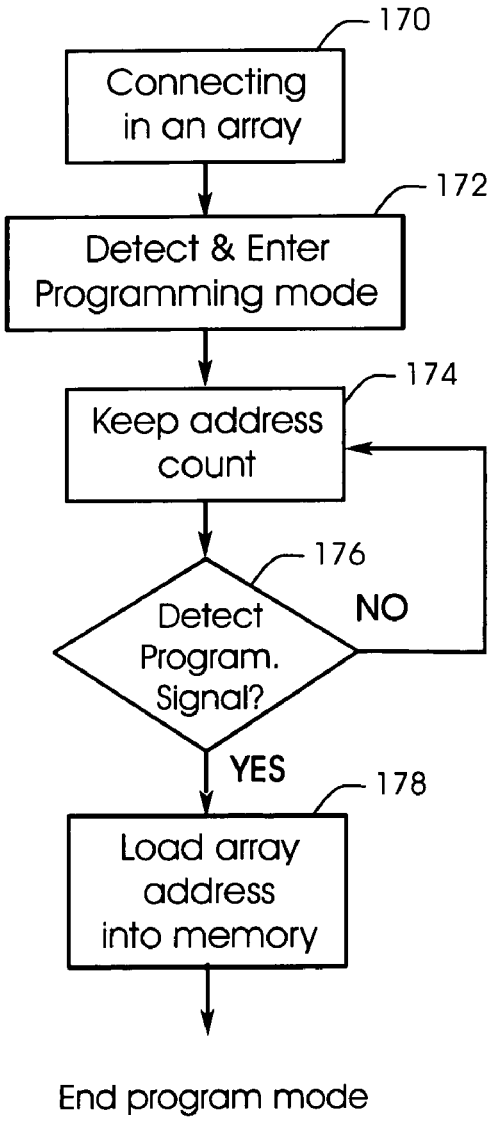
FIG. 10A-10B are flow diagrams of device programming and operation according to an embodiment of the present invention.

FIG. 10A illustrates by way of example embodiment the programming of an array of optical elements configured according to the present invention. Block 170 refers to connecting the optical element into an array prior to commencing in-situ programming in the target array. The address to which the optical elements according to the present invention are responsive is programmed onto the optical devices when they are in their target configuration. In the array configuration the optical element receives signals which drive its addressing. These same signals are received by each of the optical device elements contained in the array.

In block 172 the optical devices enter programming mode, wherein they maintain an address count at block 174. When the circuit detects receiving a programming signal at block 176, depicted as being received from an optical detector in one embodiment, it commences to load an array address (first address) into a memory, such as non-volatile memory. This first address is loaded with the current count value maintained in response to counting received clocks, as well as in response to clock control signals such as reset. This completes the general aspect of programming the array address into the display element. As a consequence of the in-situ array position addressing process, the optical device becomes configured to generate optical outputs based on data received in association an address (a second address) which matches the programmed into memory.

Figure 10B:
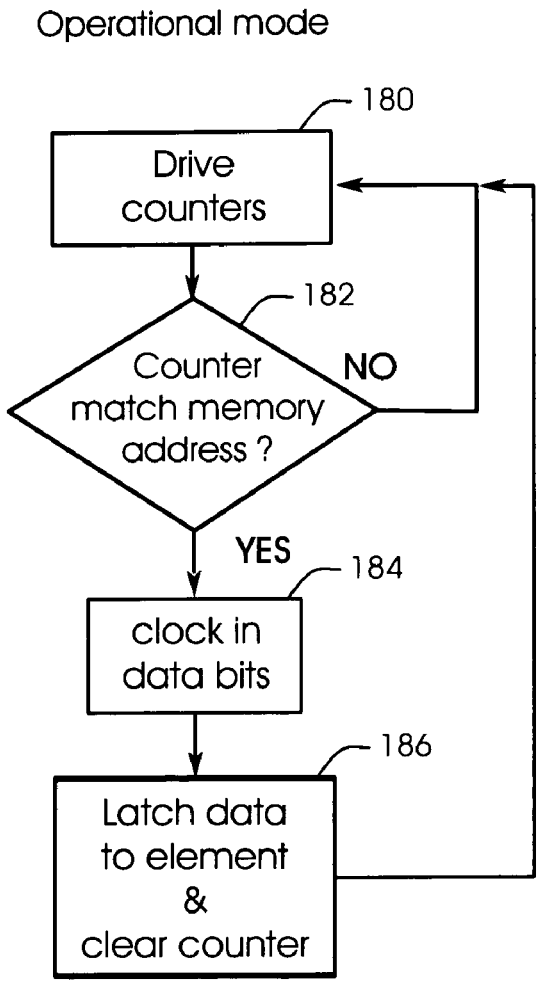

FIG. 10B illustrates by way of example embodiment the process of outputting data from the optical element in response to data and clocking being received by the device.

Represented in block 180, counters on the device are driven to maintain an address. This address, now referred to as a second address, is compared with the address stored in memory as a first address, as per block 182. If no match exists the circuit just continues counting, represented by a return to block 180. Upon matching the second address to the first address, bits of data are read in from the data signal being received by each element in the array as per block 184. The data bits are then latched for output by the optical element at block 186. At some point, such as upon receiving a counter reset clock, the data is output to drive the optical elements and the counter is reset.

The device continues to repeat the process of counting up clocks and attempting to find a match between first and second addresses wherein it knows the data on the input signal is intended for output at its array position address.

Accordingly, it will be seen that this invention provides a system and method for controlling an array of display elements, such as LEDs, without the necessity of multiplexing, nor the need of a backplane containing row and column traces along with various distributed driver circuits. The method involves the use of address encoding within the display elements which may be performed within the target circuit. Each display element extracts addressing information from the power bus over which data is superimposed. One of ordinary skill in the art will recognize that the method taught within the present invention can be practiced in a variety of implementations which similarly provide for addressing and controlling of the display elements. It will further be appreciated that the synchronous optical programming (SOP) method of the present invention may be utilized within a variety of devices for establishing an address for the device within a single or multiple axis array. For example the SOP technique may be utilized according to the present invention with any form of output elements, or even with input elements, such as optical detectors, or with combinations thereof. Although the description above contains many specificities, these should not be construed as limiting the scope of the invention but as merely providing illustrations of some of the presently preferred embodiments of this invention. Thus the scope of this invention should be determined by the appended claims and their legal equivalents. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. A display element having internal optical output control circuitry, comprising:

at least one optical element integrated within a display element configured for displaying multiple optical states;

an input configured for receiving an array position addressing signal containing array position clocking and data which are delivered in common to all said display elements within a single or multidimensional display array;

a counter configured for maintaining an array position count in response to detecting said array position clocking from said input;

a memory configured for retaining an array position;

a comparison circuit configured for generating a data load signal in response to detecting a desired relationship between said array position maintained by said counter and said array position retained in said memory;

a latch circuit configured for loading data from said input in response to receipt of said data load signal; and a driver circuit configured for outputting said data to update the optical state of said at least one optical element.

2. A display element as recited in claim 1, wherein said input comprises a single signal line coupled directly to each said display element within a given display array, or a signal superimposed on the power being supplied to each said display element within said given display array.

3. A display element as recited in claim 1, further comprising:

a shift register coupled to said input and configured to receive data bits of said array position addressing signal in response to said data load signal;

wherein said shift register is configured to output, in parallel, the data bits it has received to said latch.

4. A display element as recited in claim 1, wherein said memory comprises a non-volatile memory.

5. A display element as recited in claim 4, wherein said memory is configured for being loaded with an array position value in response to a position programming operation.

6. A display element as recited in claim 1, wherein said input comprises a separate signal connection aside from the power and ground connections of said display element.

7. A display element as recited in claim 1, wherein said input is received as a signal superimposed over said power and ground connections to said display element.

8. A display element as recited in claim 1, wherein said array position clocking and data are received for each array address in each cycle of an array position addressing signal.

9. A display element as recited in claim 8, wherein said driver is configured for outputting said data to said at least one optical element in response to detecting the end of said cycle of said array position addressing signal.

10. A display element as recited in claim 1, wherein said driver circuit is configured for modulating the optical state of each of said optical elements to either an on or off state in response to said data from said latch circuit.

11. A display element as recited in claim 1, wherein said driver circuit is configured for modulating the optical state d each of said optical elements to a desired intensity, color, or combination of intensity and color, in response to said data from said latch circuit.

12. A display element as recited in claim 1, wherein said memory is configured to retain said array position during operation and power down of said display element and until reprogrammed to a different address.

13. A display element as recited in claim 1, wherein said display element is configured for electrical connection to a base member having parallel conductive planes through which power as well as a data signal are communicating to each display element within a plurality of the display elements.

14. A display element as recited in claim 1, wherein the optical elements in a plurality of said display elements are controllably addressed as an array without the need of individual row and column signal lines.

15. A display element having internal control circuitry, comprising:

at least one optical element integrated within a display element configured for displaying multiple optical states;

a memory configured for programming to a first address associated with the position of said display element within an array of said display elements;

means for extracting output data from a data signal, received in parallel by the display element and other display elements within an array of display elements, in response to matching a second address received on said data signal with said first address; and means for modulating the output of said at least one optical element in response to said extracted output data.

16. A display element as recited in claim 15, wherein said first address comprises at least one axis of addressing.

17. A display element as recited in claim 16, wherein said first address comprises a row and column address.

18. A display element as recited in claim 15, wherein said means for extracting data is configured for extracting a predetermined number of data bits from said data signal.

19. A display element as recited in claim 18, wherein said means for extracting data is configured for counting clocks on said data signal for determining said second address.

20. A display element as recited in claim 19, wherein said clocks comprise column and row clocks.

21. A display element as recited in claim 19, wherein said means for extracting data is configured for detecting a reset clock to reset the clocks being counted in determining said second address.

22. A display element as recited in claim 15, wherein said data signal comprises either a single signal line coupled directly to each said display element within a given array of said display elements, or is superimposed on the power being supplied to each said display element within the array of display elements.

23. A display element as recited in claim 15, wherein said means for modulating the output of the optical state of said at least one optical element is conjured to update the optical state of said optical element at a fixed position within cycles of said data signal.

24. A display element as recited in claim 23, wherein said fixed position occurs at the end of a cycle of said data signal.

25. A display element as recited in claim 15, wherein said means for extracting data from said common array positioning addressing signal, comprises:

a counter configured for counting clocks to determine said second address within said data signal;

an address comparator for generating a matching signal in response to detecting a predetermined relationship between said second address determined by said counter and said first address retained within said memory; and a data store configured for collecting data bits from said data signal in response to said matching signal.

26. A display element as recited in claim 15, wherein said modulating means comprises:

a latch configured for latching and outputting data bits from said data store; and a driver circuit configured for driving said at least one optical element to provide intensity, color, or combination of intensity and color, control in response to output data being output from said latch.

27. A display element as recited in claim 26, wherein said latch is configured to output the received data in response to a predetermined position within each cycle of the data signal.

28. A display element as recited in claim 15, wherein said optical element comprises one light emitting diode (LED) of a desired color, or multiple LEDs of at least one color.

29. A display element as recited in claim 15, wherein said display element is contained within an optical housing configured with a transparent portion through which the state of said at least one optical element can be viewed.

30. A display element as recited in claim 15, wherein said memory is configured for storing said first address for the display element in response to a programming operation that programs the position of said display element according to its position within an array of display elements.

31. A display element as recited in claim 30, wherein said programming operation is performed in response to receiving an external optical programming signal while said display element is in a programming mode which loads an address received by the display element, in parallel with other display elements within an array of said display elements, as said first address into said memory.

32. A display element as recited in claim 31, wherein said external optical programming signal comprises an optical signal configured for establishing an array position address into each of the display elements contained within an array of display elements.

33. A display element as recited in claim 15, wherein said memory comprises a non-volatile memory.

34. A display element as recited in claim 26, wherein said driver circuit is configured for providing analog or digital intensity control.

35. A display element as recited in claim 15, wherein said memory, said extracting means and said modulating means are incorporated within the die of an optical element, or on an integrated circuit die to which one or more optical elements are bonded.

36. A display element as recited in claim 15, wherein said memory, said extracting means and said modulating means are integrated with a red, green, and blue optical element retained in said optical housing.

37. A display element as recited in claim 15, wherein said memory is configured to retain said first address dung operation and power down of said display element and until reprogrammed to a different address.

38. A display element as recited in claim 15, wherein said display element is configured for electrical connection to a base member having parallel conductive planes through which power as well as a data signal are communicating to each display element within a plurality of the display elements.

39. A display element as recited in claim 15, wherein the optical elements in a plurality of said display elements are controllably addressed as an array without the need of individual row and column signal lines.

40. A display element having internal control circuitry, comprising:

at least one optical element integrated within a display element configured for displaying multiple optical states;

a memory configured for storing a first address for the display element;

means for extracting output control data from a data signal, received in parallel with other display elements within an array of the display elements, in response to matching a second address received from the data signal with said first address; and means for modulating the output state of at least one said optical element in response to said extracted output control data.

41. A display element as recited in claim 40, further comprising means for programming said memory to said first address in response to the position of the display element within an array of the display elements.

42. A display element as recited in claim 41, wherein said programming means is configured for loading said second address from the data signal in response to a programming signal received by said display element and not by other display elements within an array which are not to respond to given said second address.

43. A display element as recited in claim 42, wherein said programming means is configured to program said second address in response to a combination of data received from said data signal and said programming signal.

44. A display element as recited in claim 42, further comprising an optical detector within said display element, said optical detector configured for receiving said programming signal.

45. A display element as recited in claim 44, wherein said optical detector comprises one or more of said at least one optical elements which are configured for both displaying optical states and detecting optical input.

46. A display element as recited in claim 45, wherein said optical detector comprises at least one separate optical input sensor integrated within said display element.

47. A display element as recited in claim 40, wherein said output control data is received on the data signal in a sequential scan form or random form.

48. A display element as recited in claim 40:

wherein said memory is configured to retain said first address for containing the physical address for the display element within an array of the display elements; and wherein said first address is retained during operation and power down of said display element and until reprogrammed to a different address.

49. A display element as recited in claim 40, wherein said display element is configured for electrical connection to a base member having parallel conductive planes through which power as well as a data signal are communicating to each display element within a plurality of the display elements.

50. A display element as recited in claim 40, wherein the optical elements in a plurality of said display elements are controllably addressed as an array without the need of individual row and column signal lines.

51. A display element having internal control circuitry, comprising:

at least one optical element integrated within a display element configured for displaying multiple optical states;

a memory configured for storing a first address for the display element in response to the position of the display element containing said at least one optical element within an array of said display elements;

means for extracting output control data from a common data signal received in parallel with other display elements within an array of the data elements, said output control data being extracted in response to detecting a desired relationship between said first address stored in memory and a second address received over said common data signal; and means for modulating the output of at least one said optical element in response to said extracted output control data.

52. A display element as recited in claim 51, wherein said memory is configured to retain said first address during operation and power down of said display element and until reprogrammed to a different address.

53. A display element as recited in claim 51, wherein said display element is configured for electrical connection to a base member having parallel conductive planes through which power as well as a data signal are communicating to each display element within a plurality of the display elements.

54. A display element as recited in claim 51, wherein the optical elements in a plurality of said display elements are controllably addressed as an array without the need of individual row and column signal lines.

55. A display element having internal control circuitry, comprising:

at least one optical element integrated within a display element configured for displaying multiple optical states;

a memory configured for storing a first address, for representing the position of the display element within an array of display elements, in response to programming of said memory wherein it retains the same said first address during operation of said display element;

means for receiving a data signal in common by all display elements in an array of the display elements;

means for matching a second address received from the data signal with said first address representing display element position within an array of the display elements;

means for outputting optical state data, from said data signal for this display element position within an array of display elements, in response to said matching to said at least one optical element in said display element.

56. A display element as recited in claim 55, wherein said outputting means is configured for programming said second address within said means with the display element connected in-situ on the target array.

57. A display element as recited in claim 55, wherein said outputting means is configured for receiving said data signal which each display element monitors within the array of display elements.

58. A display element as recited in claim 55, wherein said second address is programmed into non-volatile memory within said outputting means.

59. A display element as recited in claim 55, wherein said memory is configured to retain said first address until reprogrammed to a different address.

60. A display element as recited in claim 55, wherein said display element is configured for electrical connection to a base member having parallel conductive planes through which power as well as a data signal are communicating to each display element within a plurality of the display elements.

61. A display element as recited in claim 55, wherein said at least one optical element in said display element is controllably addressed within an array of the display elements without the need of individual row and column signal lines.

62. A display element having internal control circuitry, comprising:

at least one optical element integrated within a display element configured for displaying multiple optical states;

a memory configured for storing a first address for the display element;

means for programming said memory to said first address in response to the position of the display element within an array of the display elements;

an optical detector within said display element, said optical detector configured for receiving said programming signal;

means for extracting output control data from a data signal, received in parallel with other display elements within an array of the display elements, in response to matching a second address received from the data signal with said first address;

wherein said programming means is configured for loading said second address from the data signal in response to a programming signal received by said display element and not by other display elements within a same array of display elements which are not responsive to said second address; and means for modulating the output state of at least one said optical element in response to said extracted output control data.

63. A display element as recited in claim 62, wherein said memory is configured to retain said first address during operation until reprogrammed to a different address.

64. A display element as recited in claim 62, wherein said display element is configured for electrical connection to a base member having parallel conductive planes through which power as well as a data signal are communicating to each display element within a plurality of the display elements.

65. A display element as recited in claim 62, wherein said at least one optical element in said display element is controllably addressed within an array of the display elements without the need of individual row and column signal lines.

66. A display element having internal control circuitry, comprising:

at least one optical element integrated within a display element configured for displaying multiple optical states;

a memory configured for programming to a first address associated with the position of said display element within an array of said display elements;

wherein said memory is configured to retain said first address during operation until reprogrammed to a different address;

means for programming said first address in response to optical signals coupled between said at least one optical element of the display element and an optical element contained within an external programming array configured for performing optical programming;

means for extracting output data from a data signal, received in parallel by the display element and other display elements within an array of display elements, in response to a match occurring between a second address received on said data signal to said first address; and means for modulating the output of said at least one optical element in response to said extracted output data;

wherein said at least one optical element in said display element is controllably addressed within an array of the display elements that operates without the need of coupling row and column signal lines to the display elements.

67. A display element having internal control circuitry, comprising:

at least one optical element integrated within a display element configured for displaying multiple optical states;

a memory configured for storing a first address for the display element;

means for programming said first address in response to optical signals coupled between said at least one optical element of the display element and an optical element contained within an external programming array configured for performing optical programming;

means for extracting output control data from a data signal, received in parallel with other display elements within an array of the display elements, in response to matching a second address received from the data signal with said first address; and means for modulating the output state of at least one said optical element in response to said extracted output control data.

68. A display element having internal control circuitry, comprising:

an integrated circuit;

at least one optical element within a package of said integrated circuit, or attached to said integrated circuit and configured for displaying multiple optical states;

means for receiving power and a data signal received in parallel by said optical display unit and other optical display units within an array of optical display units;

a memory configured for programming to a first address for retaining a position value for said display element within an array of other display elements, said memory retained during operation until reprogrammed to a different address;

means for programming said first address in response to signals communicated to said display element and said other display elements within an array of said display elements for establishing said first address responsive to the position of said display element within the array of other display elements;

wherein said signals communicated by said means for programming are communicated responsive to array position of said display element within the array of display elements;

means for extracting output data from said data signal in response to a match occurring between a second address determined in response to said data signal and said first address; and means for modulating the output of said at least one optical element of said display element in response to said extracted output data.

69. A display element as recited in claim 68, wherein said data signal is superimposed on said power and received by said display element on the same two conductors which are coupled to other display elements within an associated display array.

70. A display element as recited in claim 68, wherein said data signal is received as a separate signal from said power, said power and data being received by said display element on the same three conductors which are coupled to other display elements within an associated display array.

71. A display element having internal control circuitry, comprising:

at least one optical element integrated within each said display element;

said display element configured for driving said at least one optical element as pixels within a display array having a plurality of pixels driven by an array of said display elements;

said optical element configured for displaying multiple optical states;

said display element configured for electrical connection to a base member having parallel conductors through which power as well as a data signal are communicating to each display element within a plurality of the display elements within a display array;

a control circuit integrated within said display element, said control circuit configured for modulating the state of said at least one optical element in response to extracting data from a serial data signal carried in parallel to said plurality of display elements;

a memory within said control circuit for retaining an array position address of the display element, within an array of display elements, which is programmed into said memory and to which this particular display element is to be responsive;

said array position address being retained during operation and power down of said display element until said display element is programmed to a different position in an array of the display elements; and a comparison circuit within said control circuit, said comparison circuit configured for receiving the serial data signal on the parallel conductors and detecting an array position address match with said array position address retained in said memory;

said control circuit configured for extracting optical state data from said serial data signal in response to said array position address match and driving the output of said at least one optical element to said optical state; and wherein said control circuit allows each said display element to be controllably addressed over the parallel conductors without the need of individual row and column signal lines.

72. A display element as recited in claim 71, wherein said display element is configured with an electrical pinout of two or three contacts adapted for connection to a base member to which an array of the display elements can be attached.

* * * * *